US005133243A

United States Patent [19]

Menges et al.

[11] Patent Number: 5,133,243

[45] Date of Patent: Jul. 28, 1992

[54] ARRANGEMENT FOR EMERGENCY ACTUATION OF THE FIRING PIN OF A MACHINE CANNON WITH AN EXTERIOR DRIVE

[75] Inventors: Horst Menges, Ratingen; Lothar Post, Duesseldorf; Bernhard Schneider, Niederkruechten, all of Fed. Rep. of Germany

[73] Assignee: Rheinmetall GmbH, Duesseldorf, Fed. Rep. of Germany

[21] Appl. No.: 874,024

[22] Filed: Jun. 2, 1986

[30] Foreign Application Priority Data

Jun. 14, 1985 [DE] Fed. Rep. of Germany ..... 3521390

[51] Int. Cl.[5] ..... F41A 7/10

[52] U.S. Cl. ..... 89/11; 89/27.11

[58] Field of Search ..... 89/9, 11, 27.11

[56] References Cited

U.S. PATENT DOCUMENTS 1,503,420 7/1924 Hutton ..... 89/27.11

4,683,799 8/1987 Post et al. ..... 89/11

*Primary Examiner*—Stephen C. Bentley

*Attorney, Agent, or Firm*—Spencer, Frank & Schneider

[57] ABSTRACT

The arrangement for emergency actuating of the firing pin of a machine cannon having an exterior drive includes a percussion hammer that is loaded by a coil spring for the direct loading of the firing pin mounted in the breech block via an intermediate rod member. When in a loaded position and therefore ready for an emergency actuation, the percussion hammer is secured in its operating position by means of an arresting spring which engages with a pair of diametrically opposite nose members into an abutments forming part of the breech housing.

8 Claims, 3 Drawing Sheets

ARRANGEMENT FOR EMERGENCY ACTUATION OF THE FIRING PIN OF A MACHINE CANNON WITH AN EXTERIOR DRIVE

BACKGROUND OF THE INVENTION

The invention relates to an arrangement for the emergency actuation of a firing bolt in a machine cannon having an exterior drive.

Machine cannons with exterior drives already are known and described in our published German patent application No. DE 3307882 (which corresponds to copending U.S. patent application Ser. No. 729,996 now U.S. Pat. No. 4,683,799. The energy required for driving such a weapon is supplied by an outside energy source, for example, an electric motor or a compressed air driving mechanism. In emergency cases, that is, when the exterior source of energy fails, the weapon needs to be capable of at least of firing single shots. For this purpose a manual drive is provided. This drive can, however, only effect block movement and an advance the ammunition transport mechanism. The energy actuating the firing bolt can, however, not be supplied with this manual driving mechanism.

SUMMARY OF THE INVENTION

It is an object of this invention to provide an arrangement which in emergency cases can also provide a manual actuating of the firing pin or bolt, so that when a malfunctioning or failure of the exterior energy drive source occurs it is possible to continue to fire the weapon.

BRIEF DESCRIPTION OF THE DRAWINGS

The above and other features and advantages of the invention will become more readily apparent from the following, reference being made to the accompanying drawing, in which.

DETAILED DESCRIPTION

Figure 1:
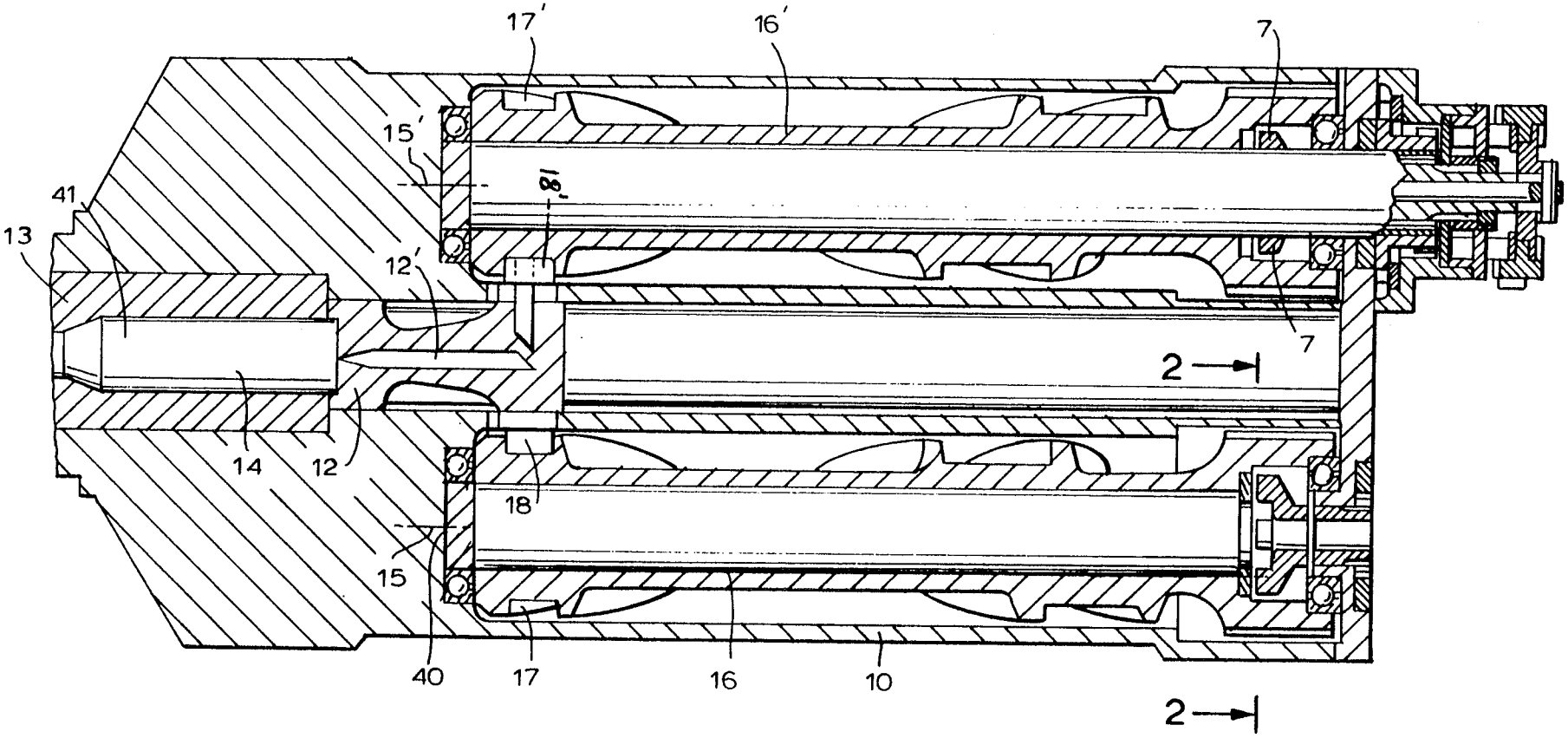
FIG. 1 illustrates in cross section the breech block in breech housing of the weapon.

FIG. 1 illustrates in cross section essentially only a portion of the weapon, that is, its breech housing 10, which is connected with gun barrel 13, which has only been partially illustrated. A breech block 12 is shown as being reciprocally slidably mounted in the breech block housing 10. The breech block 12 closes in its forwardmost position on the loading chamber 14 of the gun barrel 13, as described in our copending application Ser. No. 729,996 now U.S. Pat. No. 4,683,799. Through shafts 16, 16' mounted respectively on the axes 15, 15', extend parallelly and bilaterally with respect to the breech block 12 and also extend parallel to the breech block movement. These two shafts 16, 16' are driven by non-illustrated driving means, for example, meshing gear wheels, by means of an exterior energy source, for example, an electric motor (not illustrated), to be thereby rotatably driven. The shafts 16, 16' have cams 17, 17' disposed along their cylindrical exterior surfaces, which cams control the firing cycle of the weapon. These cams 17, 17' engage with projecting nose members 18, 18' of the breech block 12 to thereby effect a reciprocal movement of the breech block 12 within the breech block housing 10.

Figure 2:
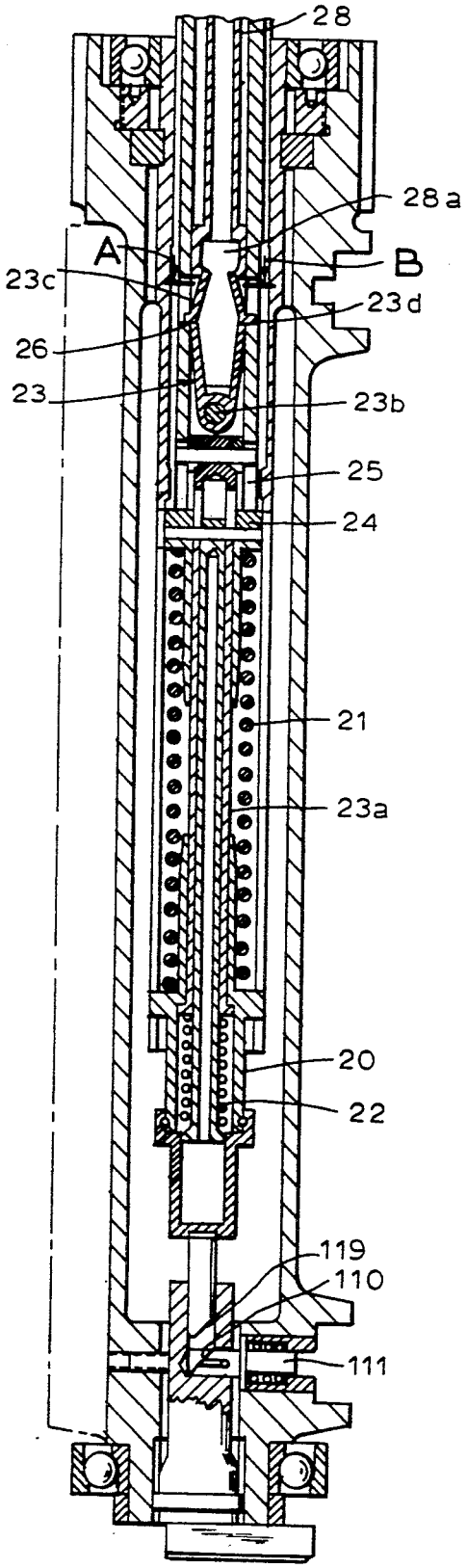
FIG. 2 is a cross sectional longitudinal view of a first embodiment of the arrangement of the invention.
Figure 3:
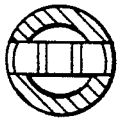
FIG. 3 is a cross sectional view along line A–B in FIG. 2.
Figure 4:
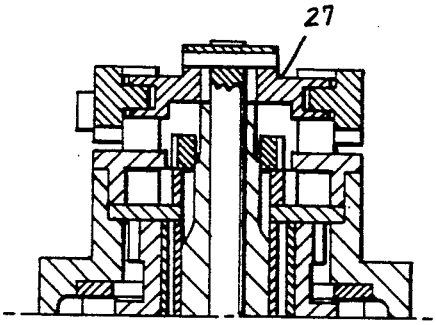
FIG. 4 is a partial cross sectional view of the arrangement shown in FIG. 2.
Figure 5:
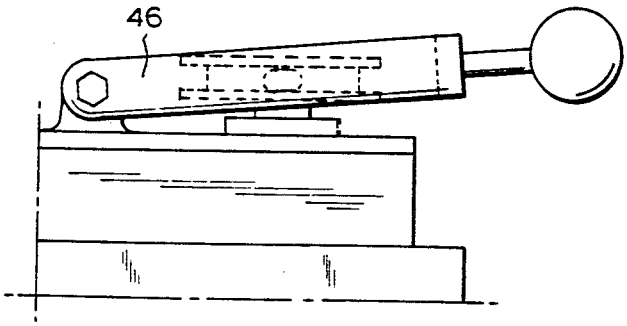
FIG. 5 is a side elevational view of the lever for actuating the arrangement of FIG. 2.
Figure 6:
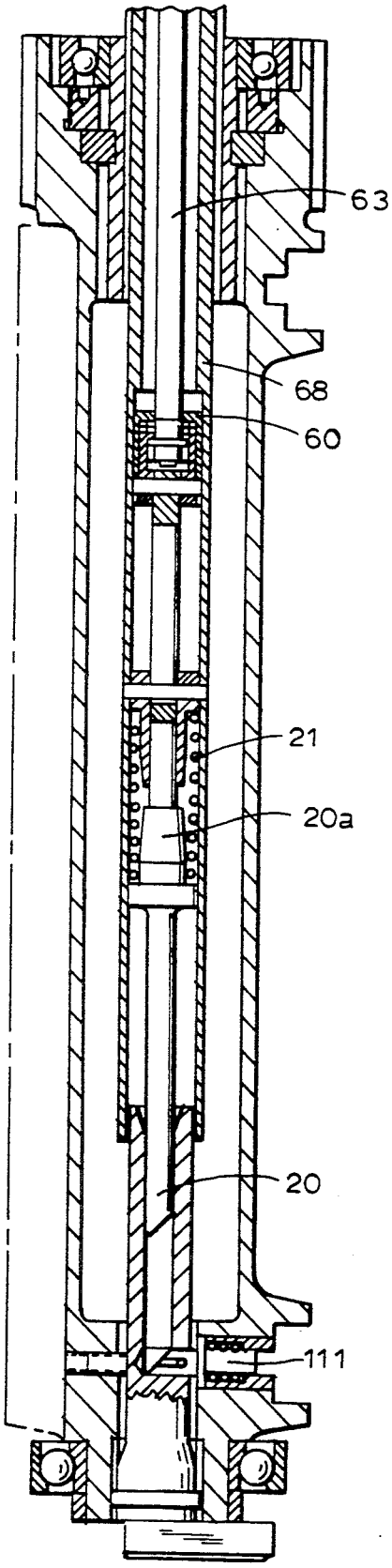
FIG. 6 is a longitudinal sectional view of a further embodiment of the invention.
Figure 7:
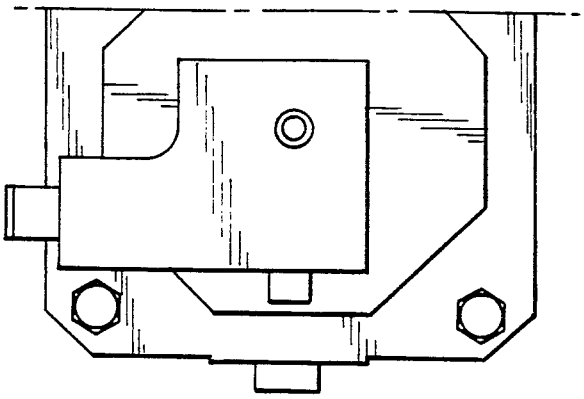
FIG. 7 is a top-plan view of the parts of the arrangement of FIG. 6 that are illustrated in side elevational view in FIGS. 8 and 9 of the second embodiment of the invention illustrated in FIG. 6.
Figure 8:
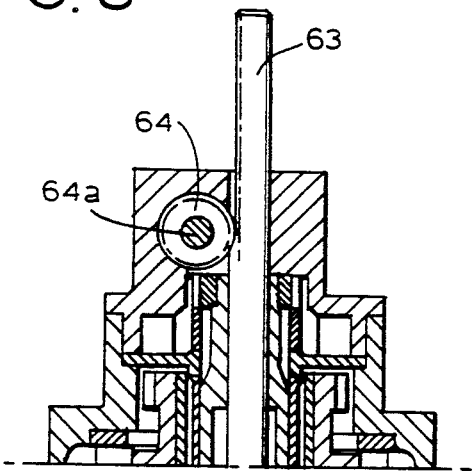
FIG. 8 is a cross sectional view of a part of the arrangement of FIG. 6.
Figure 9:
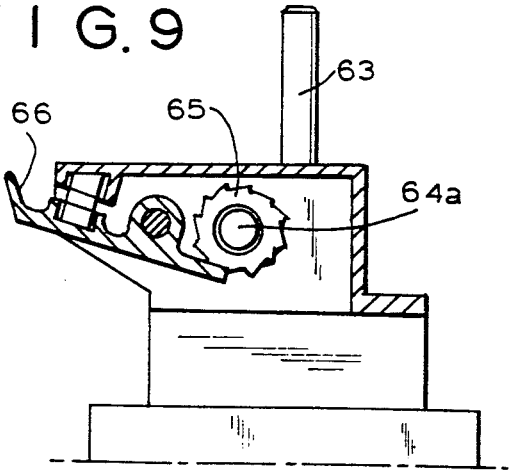
FIG. 9 is a side elevational view of the part of the arrangement illustrated in FIG. 8.

In case of emergency, that is, during malfunctioning of the exterior energy source, the shafts 16, 16' can be manually rotated by means of a non-illustrated manually actuatable driving arrangement. By so rotating the shafts 16, 16', the required movement of the breech block 12 for the proper functioning of the weapon can also be effected. However, with this emergency drive, the weapon functioning is drastically slower than during normal operation. During emergency drive conditions generally only single shots can be fired. The emergency energy provided for the manual drive does not suffice for actuation the firing pin 12' out of the breech block 12. Therefore, a further arrangement for this manually actuation must be provided. The first embodiment of such an arrangement is illustrated in connection with FIGS. 2 and 5. The arrangement for the emergency actuation of the firing pin 12' in accordance with FIG. 2, is already schematically illustrated in FIG. 1. As can be noted, it is coaxially arranged in at least one of the two hollow shafts 16, 16'. The arrangement includes a percussion hammer 20, which is biased by coil spring 21, which is biased against a counter support 24. This support 24 in turn bears against the drive shaft 25 which is not actually slidably displaceable. The recoil of the weapon, after firing a shot, causes the percussion hammer 20 to move backwards, whereby simultaneously the coil spring 21 is loaded. This loaded condition of the coil spring 21 is secured by means of the arresting means 23. The arresting means include a longitudinally, axially movable arresting rod **23*a* which is movable from a first position within the coil spring 21, and a dual-leg arresting spring 23 which is operatively joined to the arresting rod 23*a*. The arresting spring 23 is mounted on pivot pin 23*b* and is joined via said pin to the arresting rod 23A. Each leg 23*c* of the arresting spring 23 is biased radially outwardly by means of a radially outwardly directed spring force. Each leg 23*c* of the arresting spring 23 is bow-shaped and supports a radially outwardly projecting nose, 23*d*, which, in a loaded condition of the spring 21 abuts against a projection or abutment 26 for purposes of securing the arresting rod 23*a*. The free ends of the legs 23*c* of the arresting spring 23 project into mouth-shaped opening of coupling rod 28, which is slidably mounted in the emergency actuating arrangement and adjoins in the axial direction the arresting spring 23. This is particularly well illustrated in the cross sectional view on FIG. 3. The coupling rod 28 is joined with a coupling 27 (FIG. 4) which is actuatable by means of a lever 46 (FIG. 5). FIGS. 4, 5, are to be considered jointly with FIG. 2 and are really disposed above it and are not shown in this fashion for lack of space the lever 46 represents the end piece of the arrangement in accordance with FIG. 2 and a cross sectional, respectfully side elevational view of it is shown. For emergency actuating of the weapon, at closed breech, the coupling rod 28 is released by means of the coupling lever 46 and the coupling 27 and is slidable moved in an axial direction onto the arresting spring 23. During this operation, the mouth-like opening 28***a* of the coupling rod 28 slides over the free ends of the legs 23*c* of the arresting spring 23 and thereby squeezes them together in a radial direction, so that the noses 23*d* of the legs 23*c* can slide past the abutment 26 and thereby release the arresting mechanism. Thereafter, the release coil spring 21 propels forwardly and accelerates the percussion hammer 20 which transfers the released energy of the coil spring 21 via a spring-loaded annularly arranged percussion member 111 onto the firing pin 12' of the breech block 12. The firing pin 12' can now ignite in a known manner an ignition fuse of a cartridge or projectile disposed in a cartridge or projectile loading chamber by impacting the fuse of the ammunition unit so that also in case of an emergency operation a shot can be fired. The release and forward propelling coil spring 21 which, as has been previously described, impacts on the percussion hammer 20, accelerates thereby simultaneously the arresting rod 23A in an axial direction, which does thereby loads the coil spring 22 and biases it. During recoil of the weapon, they are again biased via the skewed contact surfaces 110 and 119 of the percussion member 111 and percussion hammer 20, the coil spring 21 is again biased thereby simultaneously the coil spring 22 unloaded thereby rearwardly moving the arresting rod 23*a* in an axial direction until the noses 23*d* of the legs 23*c* of the arresting spring 23 snap past the abutment 26 and return to their arrest position and the arresting means are thereby brought into their holding position. In the above-described embodiment of the invention, a considerable wear of the moving parts can be expected since the arrangement for emergency actuating of the firing pin is also loaded during normal firing at recoil of the weapon, despite the fact that the emergency actuating arrangement is used only in cases of emergency.

In the embodiment of the invention, which is illustrated in FIGS. 6–9, there are means provided to reduce the wear and thereby the useful life of the weapon, in particular those parts of the weapon forming part of the emergency actuating arrangement. The arrangement according to FIG. 6 does again include a percussion hammer 20 which is joined to a percussion member rod 20*a* . A coil spring 21, which coaxially surrounds the percussion member rod 20*a*, biases the percussion member 20 and pushes, on the other side, in an axial direction against a nonslidably displaceable drive shaft 68. The percussion member rod 20*a* is joined via the toothed rod 63 and an axial roller bearing 60 (FIGS. 6 and 8) which meshingly engage with a gear 64 which can be rotated by a means of a manual drive. The gear wheel 64 is mounted on an axial shaft 64*a* and further includes a ratchet wheel 65 whose rotational movement is controlled by means of a ratchet pawl 66. In case of emergency, the ratchet pawl 66 can be released by manual actuation and thereby the ratchet wheel 65 is released so that the coil spring 21 can be unloaded.

In this manner, the energy which is stored in the cross spring 21 is transferred via the percussion rod member 20*a* and the percussion hammer 20 as well as the intermediate percussion member 111 onto the firing pin 12*a* of the breech block 12 (FIG. 1). During normal firing, the coil spring 21 is not additionally biased in this second embodiment of the invention by means of the weapon recoil, since the stroke of the percussion rod 28 is larger than the weapon recoil. In this manner, the emergency actuation arrangement only subjected to a very reduced wear.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In an automatic machine cannon having external drive means and a pair of first cylinders rotatably bilaterally mounted relative to the breech block in the breech housing of the automatic cannon, an emergency actuating mechanism, a firing pin operatively mounted in said breech block, at least one of said pair of first cylinders being hollow, a percussion hammer being axial operatively movably mounted in said hollow, cylinder energy storage means including a first coil spring axially mounted in said hollow cylinder and biasing said hammer and propelling it against said firing pin when the energy storage means is manually released.

2. In an automatic machine cannon having external drive means the emergency actuating mechanism as set forth in claim 1, including arresting means operatively connected to said percussion hammer, said arresting means including a hollow rod coaxially mounted in said hollow cylinder and a second arresting spring mounted on said hollow rod at the end remote from said percussion hammer, said second spring having at least one pair of legs joined to each other at one of their ends.

3. In an automatic machine cannon having external drive means according to claim 2, wherein said pair of legs of said second arresting spring are radially outwardly prestressed, each of said legs of said pair of legs has an outwardly projecting nose member, said hollow rod having a pair of diametrically opposite abutments and said pair of nose members bearing against said pair of abutments when said second arresting spring arrests said arresting means.

4. In an automatic machine cannon having external drive means according to claim 3, including a coupling rod coaxially mounted in said hollow rod, said coupling rod having an open mouth at the axial end adjoining said second arresting spring, the free ends of said pair legs extending into said open mouth.

5. In an automatic machine cannon having external drive means according to claim 4, wherein said coupling rod is axially movably mounted in said hollow rod, and a lever operatively connected to said coupling rod for manually actuating the same.

6. In an automatic machine cannon having external drive means according to claim 5, including transverse force transfer means operatively mounted in said hollow, cylinder transversely to the longitudinal axis thereof for transferring the force of the forwardly propelling hammer to said firing pin operatively mounted in said breech block.

7. In an automatic machine cannon having external drive means according to claim 1, wherein said percussion hammer is operatively connected to a percussion member, said percussion member having a roller bearing operatively mounted at the end thereof which is axially remote from said percussion hammer, a gear wheel rotatably mounted in the breech housing and a toothed rod axially rearwardly extending from said roller bearing and meshing by engaging said gear wheel.

8. In an automatic machine cannon having a external drive means according to claim 7, wherein said gear wheel is axially secured to a shaft on which is also mounted a ratchet wheel, a locking pawl operatively engaging the ratchet wheel and being manually disengageable therefrom.

* * * * *